US005636412A

United States Patent [19]

Lodi et al.

[11] Patent Number: 5,636,412

[45] Date of Patent: Jun. 10, 1997

[54] FIXED CIRCUMFERENCE BINDING DEVICE WITH NON-PROTRUDING FREE END AND METHOD FOR BINDING THEREWITH

[75] Inventors: Frank Lodi, Niles, Ill.; Craig A. Hawkins, Ashiya, Japan; Richard M. Girardot, Cincinnati, Ohio; Richard R. Tompkins, Glendale Heights, Ill.

[73] Assignee: The Procter & Gamble Company, Cincinnati, Ohio

[21] Appl. No.: 551,498

[22] Filed: Nov. 1, 1995

[51] Int. Cl.[6] ..... B65D 63/14

[52] U.S. Cl. ..... 24/16 PB; 292/318; 292/322

[58] Field of Search ..... 24/16 PB, 16 R, 24/17 AP, 17 A, 30.5 R, 30.5 P; 248/74.3; 292/318, 320, 322, 325

[56] References Cited

U.S. PATENT DOCUMENTS

| | | | |
|---|---|---|---|
| 3,556,575 | 1/1971 | Farkas | 24/16 PB X |
| 3,717,906 | 2/1973 | Wells | 24/16 PB |
| 4,306,745 | 12/1981 | Wenk | 292/318 |
| 4,532,679 | 8/1985 | Scott | 24/16 PB |
| 5,193,251 | 3/1993 | Fortsch | 24/16 PB |
| 5,267,373 | 12/1993 | Chisek | 24/16 PB |
| 5,295,285 | 3/1994 | Shely | 24/16 PB |
| 5,317,787 | 6/1994 | Fortsch | 24/16 PB |
| 5,364,141 | 11/1994 | King | 292/318 |
| 5,402,971 | 4/1995 | Bower | 248/74.3 |
| 5,441,316 | 8/1995 | Georgopoulos | 292/320 |

FOREIGN PATENT DOCUMENTS

| | | | |
|---|---|---|---|
| 220160 | 3/1910 | Germany | 292/320 |

*Primary Examiner*—James R. Brittain

*Attorney, Agent, or Firm*—Michael J. D'Amelio

[57] ABSTRACT

Disclosed is a substantially permanent, fixed-circumference, non-abrasive binding device for gathering and binding plural articles, including a locking head, a tail, and an elongate strap therebetween. The head and tail ends include cooperative locking means for securing the tail end in the locking head. The tail end includes outwardly projecting tail barbs to facilitate pulling the tail end through the locking head, and subsequently to facilitate engagement of locking barbs located on the end of the strap with barb stops located in the head. A score line is preformed across the tail end at a point between the locking barbs and the tail end, to provide for a break-any tail which can be removed after engagement of the locking barbs with the barb stops in the head. Upon engagement of the locking barbs with the barb stops, the score line is at a position slightly inside of the locking head so that no sharp or abrasive edge will be exposed after the tail end is broken off.

16 Claims, 1 Drawing Sheet

FIXED CIRCUMFERENCE BINDING DEVICE WITH NON-PROTRUDING FREE END AND METHOD FOR BINDING THEREWITH

FIELD OF THE INVENTION

The present invention relates generally to cable tie fasteners and substantially permanent binding ties. The present invention relates more specifically to a substantially fixed-circumference, one-piece binding tie, having a locking head that receives and grips the barbed end of a stamp. The stamp may then be trimmed off without leaving any sharp or abrasive edges exposed.

BACKGROUND OF THE INVENTION

Cable ties have long been used to bundle a variety of objects such as electrical wires or cables. An example of such a cable tie is shown in U.S. Pat. No. 5,317,787, incorporated by reference herein. These cable ties generally include an elongate member having a head at one end, a tail at the other end, and a longitudinal stamp body therebetween. Such ties are used by wrapping the strap body around a bundle of articles and inserting the tail end through the head. The head and strap body typically include cooperating locking elements, so that when the tail is pulled tightly through the head, the locking elements secure the stamp body in the head and prevent the strap from being pulled back out of the head.

Cable ties come in various shapes and sizes, and have been used for a growing number of applications through the years. They have been employed to replace string or twine in various applications, and have been used on personal hygiene articles like bathing and cleansing implements. One implement in particular in which such binding devices have been used are synthetic cleansing sponges of the type shown in U.S. Pat. No. 5,144,744, incorporated by reference herein.

U.S. Pat. No. 5,144,744 discloses a method for manufacturing a cleansing sponge by binding a plurality of tubes of polyethylene netting together at a common center point. The traditional binding means has been string or twine, but this material tends to rot and unravel after repeated wetting and drying during use. Another problem with string and twine is that the people who tie the knots do not always use knots that will hold together, and may not cinch their knots with sufficient tension to avoid slippage. Some have used traditional cable ties for this application, to prevent the problems associated with string. However, traditional cable ties require removal of the tail end after binding the material together. The tail end is usually removed by curing it off at the locking head. This leaves an exposed rough or abrasive edge which has been found to cut or scratch human skin during use. Some have tried to minimize the exposed sharp edge by overpulling the tail through the head, cutting off the tail, then allowing the end to rebound back towards the head, so that the rough edge will be less exposed than otherwise. Overpulling the tail takes exertion of physical strength. Cutting the tail while it is being pulled is cumbersome and can be dangerous. Additionally, if cut too close to the head, the tail will no longer stay in the head and the binding device is ruined. Sometimes a device is used to cut the tail end of a tie when the tie is engaged at a predetermined tension level, but these devices have been found to leave a sharp exposed edge if not perfectly aligned with the tie during the cutting operation.

There is therefore a desire for a substantially permanent binding tie which can be used to bind a bundle of articles together, and which provides for easy removal of the exposed tail end while leaving no exposed rough or sharp edge sticking out of the locking head. This device becomes particularly important when binding ties are necessary for applications that come in contact with human skin, or other abrasion-sensitive applications.

SUMMARY OF THE INVENTION

Disclosed is a binding device which includes an elongated member having a locking head at one end, a tail at the other end, the tail having a tapered tip, and a central binding strap body therebetween. The head includes a passage or feed hole therethrough for insertion of the tail tip and receipt of the tail. The head and the tail include cooperative locking members, which may be at least one barb stop in the head and at least one locking barb in the tail, for locking the tail in the head passage at a fixed position on the tail to form a substantially fixed circumference binding member. The tail further includes a predetermined area of reduced thickness, or score line, across the tail at a point between the tail locking member and the tip, whereby the area of reduced thickness is positioned within the head after engagement of the cooperative locking members, so that the tail may be broken off at the area of reduced thickness without leaving an exposed rough edge.

The binding device may include a plurality of outwardly extending protrusions, or tail barbs, on the tail for enhancing manual gripping of the tail. The plurality of outwardly extending protrusions on the tail may engage with the head locking member, as the tail is being inserted into the head, to prevent the tail from sliding back out of the head. A stopping member, or shoulder stop, may be positioned on the binding strap so as to allow the tail locking member to engage the head locking member, while at the same time preventing the binding strap from being inserted through the head beyond the position of the stopping member. The outer portion of the head may be configured so as to form a smooth, non-abrasive surface.

Also disclosed is a method of substantially permanent, fixed circumference binding of articles including the steps of gathering the articles at a common binding point, and wrapping the articles about the binding point with a substantially permanent, fixed circumference, binding device. The device has a locking head, a tail, and an elongated strap therebetween. The head has a passage therethrough, and the tail has a tip. The head and tail have cooperating locking members, so that after inserting the tail through the head passage, it can be pulled through the head passage to an extent so as to engage the cooperating locking members. The tail may be broken off of the engaged device at a predetermined score line, the score line being located at a point on the tail between the tail locking member and the tail tip. The score line is positioned within the head after locking engagement of the device.

The step of providing the tail with a plurality of outwardly extending protrusions for enhancing manual gripping of the tail may also be included. The plurality of outwardly extending protrusions on the tail can engage with the head locking member, as the tail is being inserted into the head, to prevent the tail from sliding back out of the head. The device may be provided with a stopping member, having a position on the strap so as to allow the tail locking member to engage the head locking member, while at the same time preventing the strap from being inserted through the head beyond the position of the stopping member. The outer portion of the head may be provided with a configuration which forms a smooth, non-abrasive surface. The step of breaking the tail off may include wiggling and twisting the tail to cause fracture at the score line.

BRIEF DESCRIPTION OF THE DRAWINGS

While the specification concludes with claims particularly pointing out and distinctly claiming the subject invention, it is believed the same will be better understood from the following description taken in conjunction with the accompanying drawings in which:

DETAILED DESCRIPTION OF THE INVENTION

Figure 1:
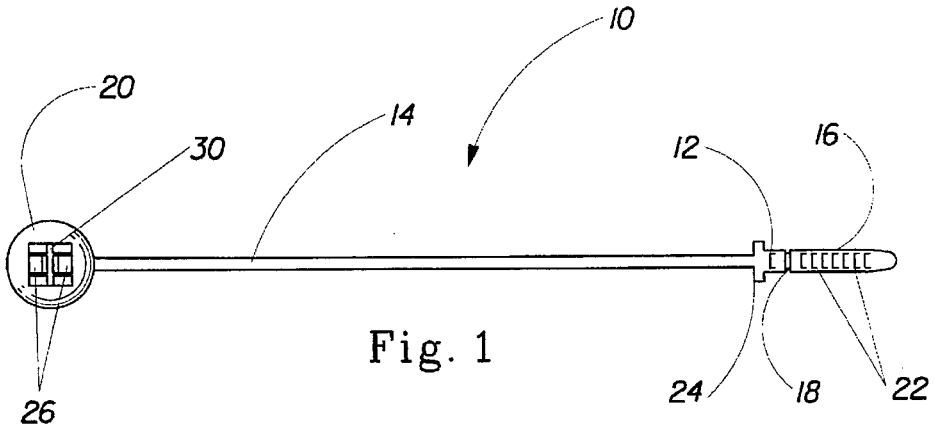
FIG. 1 is a top view of a binding device of the present invention before locking engagement of the tail and head ends.

Referring now to the drawings in detail wherein like numerals indicate the same element throughout the views there is shown in FIG. 1 a specific embodiment of binding device 10 of the present invention. Binding device 10 is typically an elongate, one-piece, integrally molded plastic member to be used to wrap around articles or bundles of articles as described above. These devices are made from a variety of polymers, including acetals and nylon, but they may also be made from metals, a combination of metals and polymers, or from a variety of other materials. Device 10 is similar to a traditional cable tie, except that rather than ratchet locking at any of a plurality of points along the strap—i.e., capable of variable circumference binding—device 10 is designed to lock at only one specified point, locking barbs 12, thereby providing a fixed circumference upon locking engagement. The length of strap 14 is predetermined and preset to provide a specific level of tightness for a given specified use. Tail 16 may be removed while leaving a safe, smooth trimmed edge provided by a fracture or score line 18 between tail 16 and strap 14. This edge is positioned within head 20 after locking engagement and tail removal, so no sharp or abrasive edge is left exposed. Head 20 is preferably rounded and smooth to eliminate the potential for abrasive surfaces.

Figure 2:
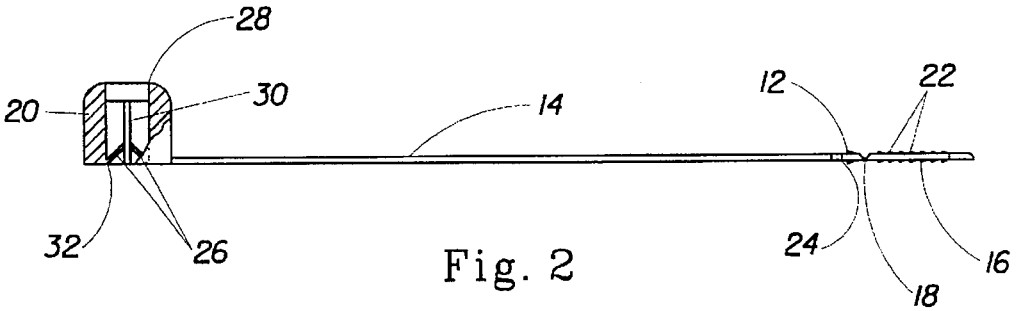
FIG. 2 is a side view of the binding device of FIG. 1.

Binding device 10 has locking head 20 at one end, tail 16 at the other end, and binding strap 14 extending between the two ends. Binding strap 14 is typically smooth and flat, but can be configured in a variety of ways so long as the configuration does not interfere with locking engagement of head 20 and tail 16. Tail 16 is configured with tail barbs 22 on both sides to facilitate insertion of tail 16 into locking head 20, as shown in FIG. 2 and as will be described in more detail below. Below tail barbs 22 is score line 18 which facilitates removal of tail 16 after locking engagement of binding device 10. Score line 18 is a line of reduced material thickness across tail 16, which readily breaks when tail 16 is bent or twisted with respect to binding strap 14. At the end of binding strap 14 are locking barbs 12, which are engaged with locking head 20 during use. Just below locking barbs 12 is shoulder stop 24 which prevents tail end 16 from being pulled too far through head 20. Binding device 10 may be provided without shoulder stop 24, but the rough edge left after tail 16 is broken off would then be free to protrude outside of head 20 if&vice 10 was not tightly secured, and in tension, around a bundle of articles. In any event, barb stops 26, within head 20, would prevent locking barbs 12 from coming disengaged from head 20.

Figure 3:
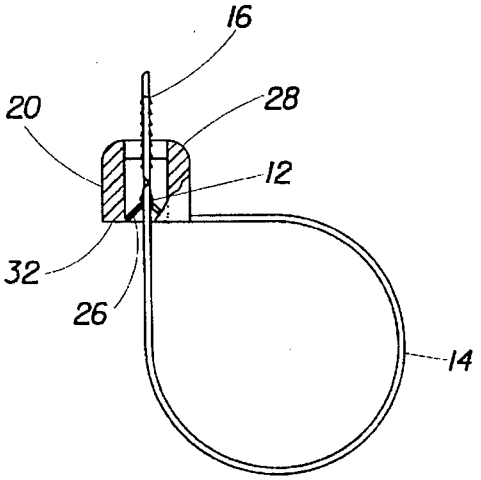
FIG. 3 is a side view of the binding device of FIG. 2 after locking engagement of the tail and head ends.

Head 20 includes outer portion 28 and feed hole 30. Outer portion 28 is typically rounded and smooth to avoid occurrence of abrasion by binding device 10 to any sensitive surface, such as human skin. Inside locking head 20, barb stops 26 provide for locking engagement with locking barbs 12, as shown in FIG. 3. Barb stops 26 are spaced apart, configured, and dimensioned so as to flex away from each other as tail barbs 22 and locking barbs 12 are inserted through them, but resilient enough to spring back toward each other and substantially come into contact with opposing sides of binding strap 14. Because of this resiliency, the protrusions of tail barbs 22 and locking barbs 12 come into interference with the tips of barb stops 26 if tail 16 tends to slide backward out of head 20 after insertion. This disallows tail end 16 from sliding back past barb stops 26 once they are inserted beyond them. When locking barbs 12 are inserted beyond barb stops 26, shoulder stop 24 will thereafter come into contact with back surface 32 of head 20 and prevent binding strap 14 from being inserted through head 20 any further.

Figure 4:
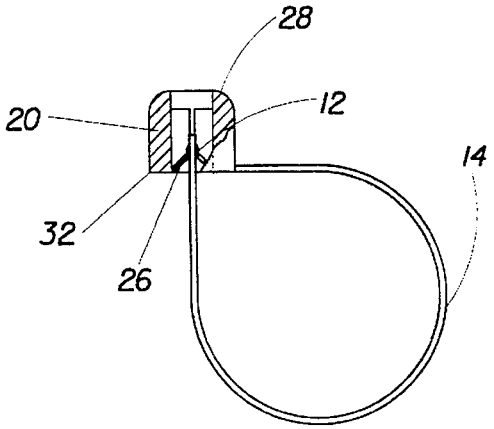
FIG. 4 is a side view of the binding device of FIG. 3 after breaking off the tail end at the score line.

At this point, score line 18 is at a position inside of locking head 20, as shown in FIG. 3, and the tip of tail 16 is exposed outside of head 20. Tail 16 may be removed without leaving any exposed rough edge by simply moving or twisting it with respect to head 20 until separation occurs at score line 18, as shown in FIG. 4. The result is a relatively strong, substantially permanent, substantially fixed-circumference, substantially non-abrasive binding member which is suitable for use in applications where the binding member may come into contact with human skin or other sensitive materials.

While particular embodiments of the present invention have been illustrated and described herein it will be obvious to those skilled in the art that various changes and modifications can be made without departing from the spirit and scope of the present invention and it is intended to cover in the appended claims all such modifications that are within the scope of this invention.

What is claimed is:

1. A binding device comprising:

an elongate member having a head at one end, a tail at the other end, the tail having a tip, and a central binding strap body therebetween;

the head including a passage therethrough for insertion of the tail tip and receipt of the tail;

the head and the tail including cooperative locking members for locking the tail in the head passage at a fixed position on the tail to form a substantially fixed circumference binding member; and the tail further including a predetermined area of reduced thickness across the tail at a point between the tail locking member and the tip, whereby the area of reduced thickness is positioned within the head after engagement of the cooperative locking members, so that the tail may be broken off at the area of reduced thickness without leaving an exposed rough edge, and the locking members remain substantially permanently engaged.

2. A binding device of claim 1 wherein the tail further comprises a plurality of outwardly extending protrusions for enhancing manual gripping of the tail.

3. A binding device of claim 2 wherein the plurality of outwardly extending protrusions on the tail engage with the head locking member, as the tail is being inserted into the head, to prevent the tail from sliding back out of the head.

4. A binding device of claim 1 further comprising a stopping member, positioned on the binding strap so as to allow the tail locking member to engage the head locking member, while at the same time preventing the binding strap from being inserted through the head beyond the position of the stopping member.

5. A binding device of claim 1 further comprising an outer portion of the head which is configured so as to form a smooth, non-abrasive surface.

6. A binding device comprising:

an elongate member having a locking head at one end, a tail at the other end, the tail having a tapered tip, and a central binding strap body therebetween;

the head including a feed hole therethrough for insertion of the tail tip and receipt of the tail;

the head including at least one barb stop and the tail including at least one locking barb which cooperate to lock the tail in the feed hole so as to form a substantially fixed circumference binding member; and the tail further including a score line across the tail at a point between the locking barb and the tip, whereby the score line is positioned within the head after engagement of the locking barb and barb stop, so that the tail may be broken off at the score line without leaving an exposed rough edge, and the locking barb and barb stop remain substantially permanently engaged.

7. A binding device of claim 6 wherein the tail further comprises a plurality of tail barbs for enhancing manual gripping of the tail.

8. A binding device of claim 7 wherein the plurality of tail barbs on the tail engage with the barb stop, as the tail is being inserted into the head, to prevent the tail from sliding back out of the head.

9. A binding device of claim 6 further comprising a shoulder stop, positioned on the binding strap so as to allow the locking barb to engage the barb stop, while at the same time preventing the binding strap from being inserted through the head beyond the position of the shoulder stop.

10. A binding device of claim 6 further comprising an outer portion of the head which is configured so as to form a smooth, non-abrasive surface.

11. A method of substantially permanent, fixed circumference binding of articles comprising the steps of:

gathering the articles at a common binding point;

providing a substantially permanent, fixed circumference, binding device, the device having a locking head, a tail, and an elongated strap therebetween, the head having a passage therethrough, the tail having a tip, and the head and tail having cooperating locking members;

wrapping the articles about the binding point with the binding device;

inserting the tail through the head passage;

pulling the tail through the head passage to an extent so as to engage the cooperating locking members; and breaking the tail off of the engaged device at a predetermined score line, the score line being located at a point on the tail between the tail locking member and the tail tip, and the score line being positioned within the head after engagement, leaving the locking members substantially permanently engaged.

12. A method of claim 11 including the step of providing the tail with a plurality of outwardly extending protrusions for enhancing manual gripping of the tail.

13. A method of claim 12 wherein the plurality of outwardly extending protrusions on the tail engage with the head locking member, as the tail is being inserted into the head, to prevent the tail from sliding back out of the head.

14. A method of claim 11 including the step of providing a stopping member, having a position on the strap so as to allow the tail locking member to engage the head locking member, while at the same time preventing the strap from being inserted through the head beyond the position of the stopping member.

15. A method of claim 11 including the step of providing an outer portion of the head with a configuration which forms a smooth, non-abrasive surface.

16. A method of claim 11 wherein the step of breaking the tail off includes wiggling and twisting the tail to cause fracture at the score line.

* * * * *